US009531050B2

(12) United States Patent
Kroening et al.

(10) Patent No.: US 9,531,050 B2
(45) **Date of Patent: *Dec. 27, 2016**

(54) FERRITE CIRCULATOR WITH ASYMMETRIC DIELECTRIC SPACERS

(71) Applicant: Honeywell International Inc., Morristown, NJ (US)

(72) Inventors: Adam M. Kroening, Atlanta, GA (US); Lance Covert, Montgomery, AL (US)

(73) Assignee: Honeywell International Inc., Morris Plains, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/829,183

(22) Filed: Aug. 18, 2015

(65) Prior Publication Data

US 2015/0357697 A1 Dec. 10, 2015

Related U.S. Application Data

(60) Division of application No. 14/638,755, filed on Mar. 4, 2015, which is a continuation of application No. 13/847,011, filed on Mar. 19, 2013, now Pat. No. 9,000,859.

(51) Int. Cl.

| | |
|---|---|
| ***H01P 1/39*** | (2006.01) |
| ***H01P 1/383*** | (2006.01) |
| ***H01P 1/38*** | (2006.01) |

(52) U.S. Cl.

CPC ..... *H01P 1/383* (2013.01); *H01P 1/38* (2013.01); *H01P 1/39* (2013.01)

(58) Field of Classification Search

CPC ..... H01P 1/39

USPC ..... 333/1.1, 24.2

See application file for complete search history.

(56) References Cited

U.S. PATENT DOCUMENTS

| | | | |
|---|---|---|---|
| 4,697,158 | A | 9/1987 | Hoover et al. |
| 7,170,362 | B2 | 1/2007 | Kingston et al. |
| 7,176,767 | B2 | 2/2007 | Kroening |
| 7,242,263 | B2 | 7/2007 | Kroening |
| 7,280,004 | B2 | 10/2007 | Kroening |
| 7,683,731 | B2 | 3/2010 | Kroening |
| 8,217,730 | B1 | 7/2012 | Catoiu |
| 8,786,378 | B2 | 7/2014 | Kroening |
| 8,878,623 | B2 | 11/2014 | Kroening |

(Continued)

FOREIGN PATENT DOCUMENTS

| | | |
|---|---|---|
| DE | 2021484 | 11/1971 |
| EP | 2698863 | 2/2014 |

OTHER PUBLICATIONS

European Patent Office, "Office Action from EP Application No. 14150084.3 mailed Jul. 28, 2014", from Foreign Counterpart of U.S. Appl. No. 13/847,011, Jul. 28, 2014, pp. 1-5, Published in: EP.

(Continued)

*Primary Examiner* — Stephen E Jones

(74) *Attorney, Agent, or Firm* — Fogg & Powers LLC

(57) ABSTRACT

A circulator for a waveguide is provided. The circulator comprises a waveguide housing including a central cavity, and a ferrite element disposed in the central cavity of the waveguide housing, with the ferrite element including a first surface and an opposing second surface. The circulator also comprises a pair of asymmetric dielectric spacers including a first dielectric spacer located on the first surface of the ferrite element, and a second dielectric spacer located on the second surface of the ferrite element.

18 Claims, 8 Drawing Sheets

(56) References Cited

U.S. PATENT DOCUMENTS

| | | | |
|---|---|---|---|
| 8,902,012 | B2 | 12/2014 | Kroening |
| 8,947,173 | B2 | 2/2015 | Kroening |
| 9,000,859 | B2 | 4/2015 | Kroening et al. |
| 2007/0139131 | A1 | 6/2007 | Kroening |

OTHER PUBLICATIONS

European Patent Office, "European Search Report from EP Application No. 14150084.3 mailed Jul. 17, 2014", from Foreign Counterpart of U.S. Appl. No. 13/847,011, Jul. 17, 2014, pp. 1-4, Published in: EP.

U.S. Patent and Trademark Office, "Notice of Allowance", from U.S. Appl. No. 13/847,011, Dec. 9, 2014, pp. 1-5, Published in: US.

U.S. Patent and Trademark Office, "Office Action", from U.S. Appl. No. 13/847,011, Oct. 28, 2014, pp. 1-20, Published in: US.

U.S. Patent and Trademark Office, "Restriction Requirement", from U.S. Appl. No. 13/847,011, Sep. 24, 2014, pp. 1-6, Published in: US.

U.S. Patent and Trademark Office, "Notice of Allowance", U.S. Appl. No. 14/638,755, Jul. 20, 2015, pp. 1-5.

U.S. Patent and Trademark Office, "Office Action", U.S. Appl. No. 14/638,755, Jun. 17, 2015, pp. 1-12.

U.S. Patent and Trademark Office, "Restriction Requirement", U.S. Appl. No. 14/638,755, May 5, 2015, pp. 1-6.

Helszajn et al., "Verification of First Circulation Conditions of Turnstile Waveguide Circulators Using a Finite-Element Solver", IEEE Transactions on Microwave Theory and Techniques, Jul. 2005, pp. 2309-2316, vol. 53, No. 7, Publisher: IEEE.

Khilla, "Design of Wide-Band H-Plane Waveguide Y-Circulatorys", Archiv fuer Elektronik and Uebertragungstechnik, Jun. 1, 1982, pp. 258-260, vol. 36.

European Patent Office, Communication Under Rule 71(3) EPC, from foreign counterpart of U.S Appl. No. 14/829,183, Feb. 22, 2016, pp. 125, Published in: EP.

FERRITE CIRCULATOR WITH ASYMMETRIC DIELECTRIC SPACERS

This application is a divisional of U.S. application Ser. No. 14/638,755, filed on Mar. 4, 2015, which is a continuation of U.S. application Ser. No. 13/847,011, filed on Mar. 19, 2013, now U.S. Pat. No. 9,000,859, the disclosures of both of which are incorporated by reference.

This invention was made with Government support under Government Contract No. H94003-04-D-0005. The Government has certain rights in the invention.

BACKGROUND

Ferrite circulators for waveguides commonly have a pair of symmetrical dielectric spacers used either for centering a ferrite element in the height of the waveguide or to improve the thermal path from the ferrite element to a metal housing structure. For moderate power handling, the thermal path through one spacer is sufficient to cool the ferrite element, so only one of the two spacers might be bonded to the housing structure for ease of assembly. While the second spacer could be eliminated from a thermal standpoint, the dielectric loading the second spacer provides is often required to provide adequate radio frequency (RF) performance.

Mechanically, the stack-up of two spacers and one ferrite element must fit in the height of the waveguide, which provides a tolerancing issue. Tight tolerances must be held on the height of all of the parts, but parts are commonly scrapped during manufacture because the stack-ups are either too short or too tall to work correctly in the waveguide, either due to mechanical fit or RF performance issues.

SUMMARY

A circulator for a waveguide comprises a waveguide housing including a central cavity, and a ferrite element disposed in the central cavity of the waveguide housing, with the ferrite element including a first surface and an opposing second surface. The circulator also comprises a pair of asymmetric dielectric spacers including a first dielectric spacer located on the first surface of the ferrite element, and a second dielectric spacer located on the second surface of the ferrite element.

BRIEF DESCRIPTION OF THE DRAWINGS

Understanding that the drawings depict only exemplary embodiments and are not therefore to be considered limiting in scope, the exemplary embodiments will be described with additional specificity and detail through the use of the accompanying drawings, in which.

DETAILED DESCRIPTION

In the following detailed description, embodiments are described in sufficient detail to enable those skilled in the art to practice the invention. It is to be understood that other embodiments may be utilized without departing from the scope of the invention. The following detailed description is, therefore, not to be taken in a limiting sense.

A ferrite circulator for a waveguide is provided with asymmetric dielectric spacers. The circulator generally comprises a waveguide housing including a central cavity, a ferrite element disposed in the central cavity, and a pair of asymmetric dielectric spacers including a first dielectric spacer located on a first surface of the ferrite element, and a second dielectric spacer located on a second surface of the ferrite element. The asymmetric dielectric spacers can be formed with different materials, sizes, or shapes, as needed for a particular implementation.

The ferrite circulator solves the mechanical fit and tolerance problems associated with standard circulator stack-ups, while also improving the nominal location of a ferrite element with respect to the center of the height of a waveguide structure.

In one embodiment, one of the two spacers is fabricated from a higher dielectric constant material than the other. This higher dielectric constant spacer can be made smaller than the opposing spacer, while still presenting a symmetric view with respect to the RF fields. An intentional air gap can be left between the higher dielectric spacer and a broad wall of the waveguide, allowing for tolerance stack up and higher yields.

Using a higher dielectric constant material for one spacer allows this spacer to be undersized while still preserving the same effective dielectric constant as the other spacer. A standard spacer height dimension can set the location of the ferrite element in the waveguide, but this height can be dimensioned to nominally center the ferrite element instead of keeping it undersized so that the entire stack-up will fit in the waveguide over full tolerances. The higher dielectric constant spacer will not influence the location of the ferrite element in the housing, and can be dimensioned so that the air gap will remain above it over all tolerances.

Manufacture and assembly of the parts can follow standard procedures, but care should be taken to bond the lower dielectric constant spacer to the waveguide housing and not the higher dielectric constant spacer, which should be separated from the housing by the air gap.

In other embodiments, the asymmetric spacers can have different diameters, thicknesses (heights), or shapes in order to provide asymmetric features.

Various embodiments of the ferrite circulator with asymmetric dielectric spacers are described hereafter with respect to the drawings.

Figure 1A:
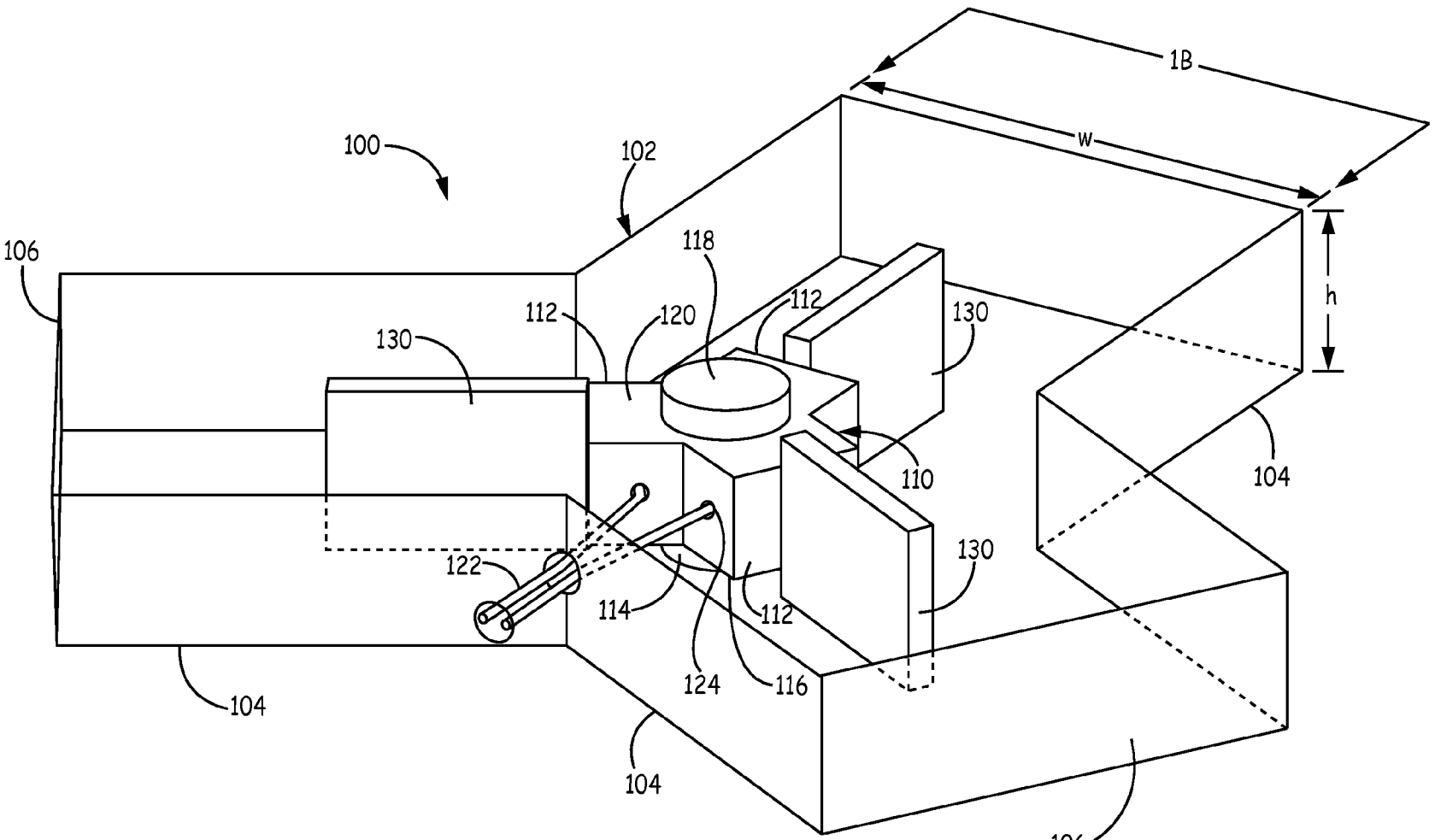
FIG. 1A is an isometric view of a circulator with asymmetric dielectric spacers according to one embodiment.
Figure 1B:
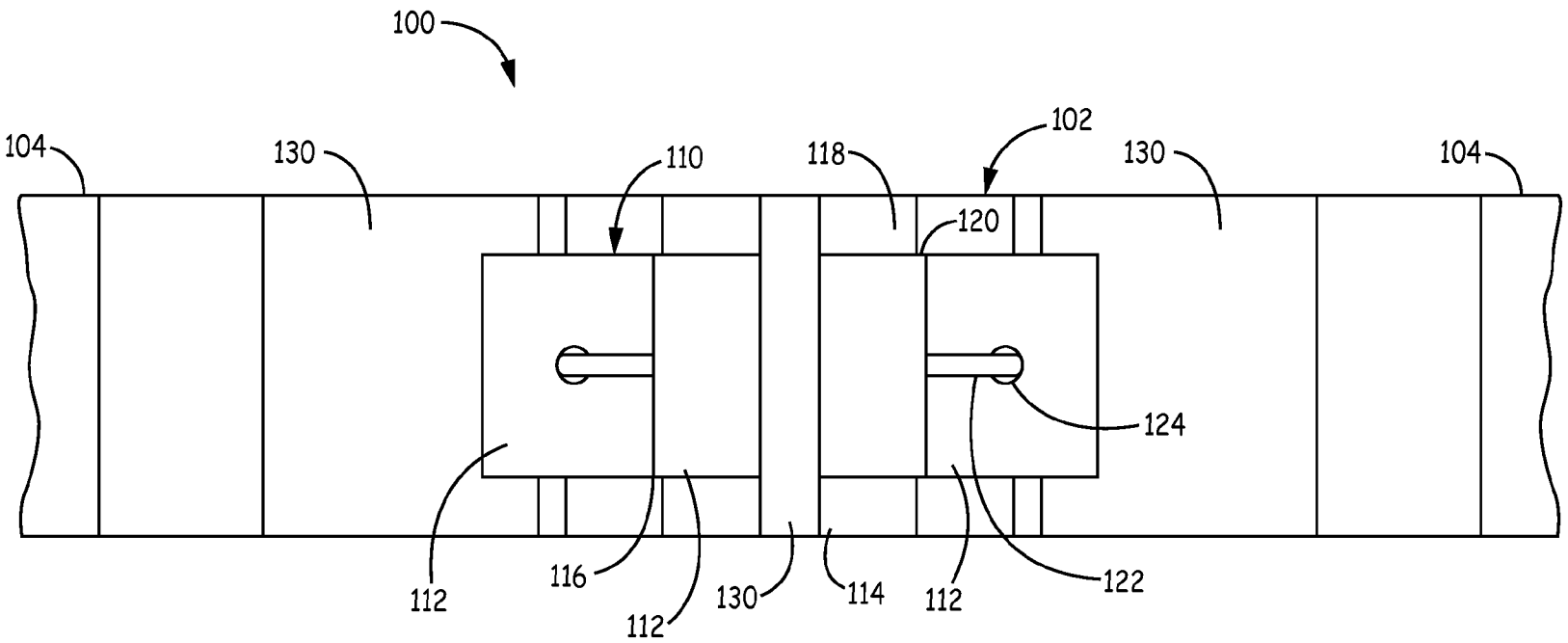
FIG. 1B is a side view of the circulator of FIG. 1A.

FIGS. 1A and 1B illustrate a circulator 100 with asymmetric dielectric spacers according to one embodiment, in which the spacers are composed of different dielectric materials as described further hereafter. The circulator 100 includes a waveguide housing 102, which includes a plurality of waveguide arms 104 such as three waveguide arms that extend from a central cavity of housing 102. As shown in FIG. 1A, waveguide housing 102 can be dimensioned to have sidewalls (short walls) with a height h, as well as and top and bottom walls (broad walls) with a width w that is greater than height h of the sidewalls. The top wall of waveguide housing 102 is removed in FIG. 1A to show the internal circulator components discussed hereafter.

The waveguide arms 104 each have a port 106, which can be used to provide an interface such as for signal input/output, for example. The waveguide housing 102 can be composed of a conductive material, such as aluminum, a silver-plated metal, a gold-plated metal, and the like.

A ferrite element 110 is disposed in the central cavity of waveguide housing 102. The ferrite element 110 includes a plurality of segments 112 that each protrude toward a separate waveguide arm 104. As shown in the exemplary embodiment of FIG. 1A, ferrite element 110 has a Y-shaped structure with three segments 112. In other embodiments, the ferrite element can be other shapes, such as a triangular puck, a cylinder, and the like.

A first spacer 114 is disposed on a first surface 116 of ferrite element 110 and a second spacer 118 is disposed on a second surface 120 of ferrite element 110. The first spacer 114 and the second spacer 118 have substantially the same circular shape, but are composed of different dielectric materials. For example, the dielectric material of the first spacer 114 can have a lower dielectric constant than the dielectric material of the second spacer 118. Exemplary dielectric materials for the first spacer 114 include boron nitride and beryllium oxide. Exemplary dielectric materials for the second spacer 118 include forsterite and cordierite.

In one embodiment, the first dielectric spacer 114 and the second dielectric spacer 118 can have substantially the same size, such as shown in FIG. 1B. In other embodiments, the first and second dielectric spacers can have different sizes and shapes, such as described hereafter.

The first spacer 114, having a lower dielectric constant, is used to securely position ferrite element 110 in waveguide housing 102 and provides a thermal path out of ferrite element 110 for high power applications. For example, the first spacer 114 can be bonded to waveguide housing 102. The second spacer 118, having a higher dielectric constant, can be separated from waveguide housing 102 by an air gap in some embodiments.

A magnetizing winding 122 can be threaded through a channel 124 in segments 112 in order to make ferrite element 110 switchable. When a current pulse is applied to winding 122, ferrite element 110 is latched into a certain magnetization. By switching the polarity of the current pulse applied to winding 122, the signal flow direction in circulator 100 can be switched from one waveguide arm 104 to another waveguide arm 104.

In one implementation, a dielectric transformer 130 is respectively attached to each end of a segment 112 of ferrite element 110 that protrudes toward a waveguide arm 104. The dielectric transformers 130 aid in the transition from ferrite element 110 to the air-filled waveguide arms 104. The dielectric transformers 130 can match the lower impedance of ferrite element 110 to that of the air-filled waveguide arms 104 to reduce signal loss.

In general, the waveguide arms 104 convey microwave energy into and out of circulator 100 through ferrite element 110. For example, one of waveguide arms 104 can function as an input arm and the other waveguide arms 104 can function as output arms, such that a microwave signal propagates into circulator 100 through the input arm and is transmitted out of circulator 100 through one of the output arms.

Figure 2A:
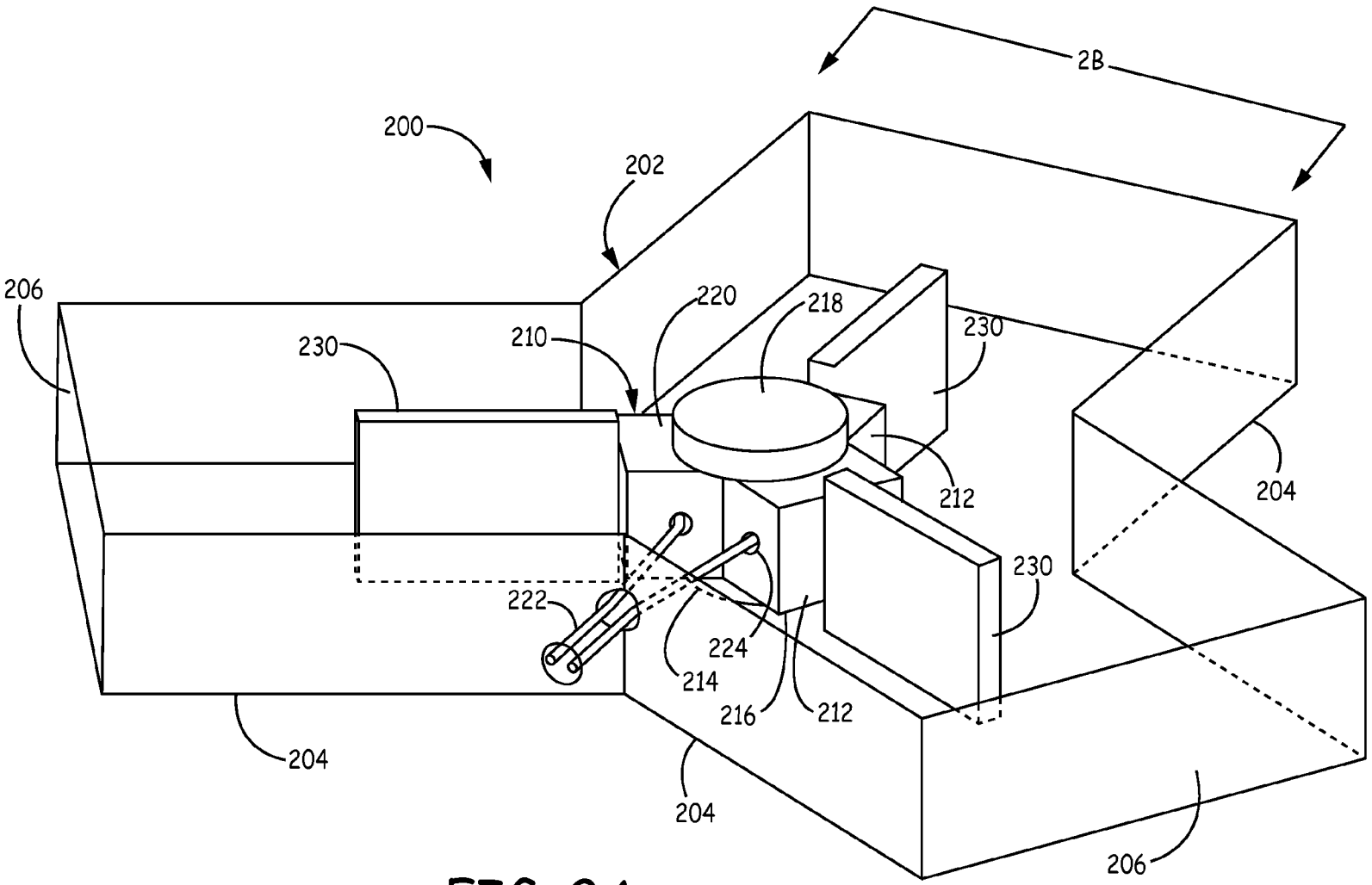
FIG. 2A is an isometric view of a circulator with asymmetric dielectric spacers according to another embodiment.
Figure 2B:
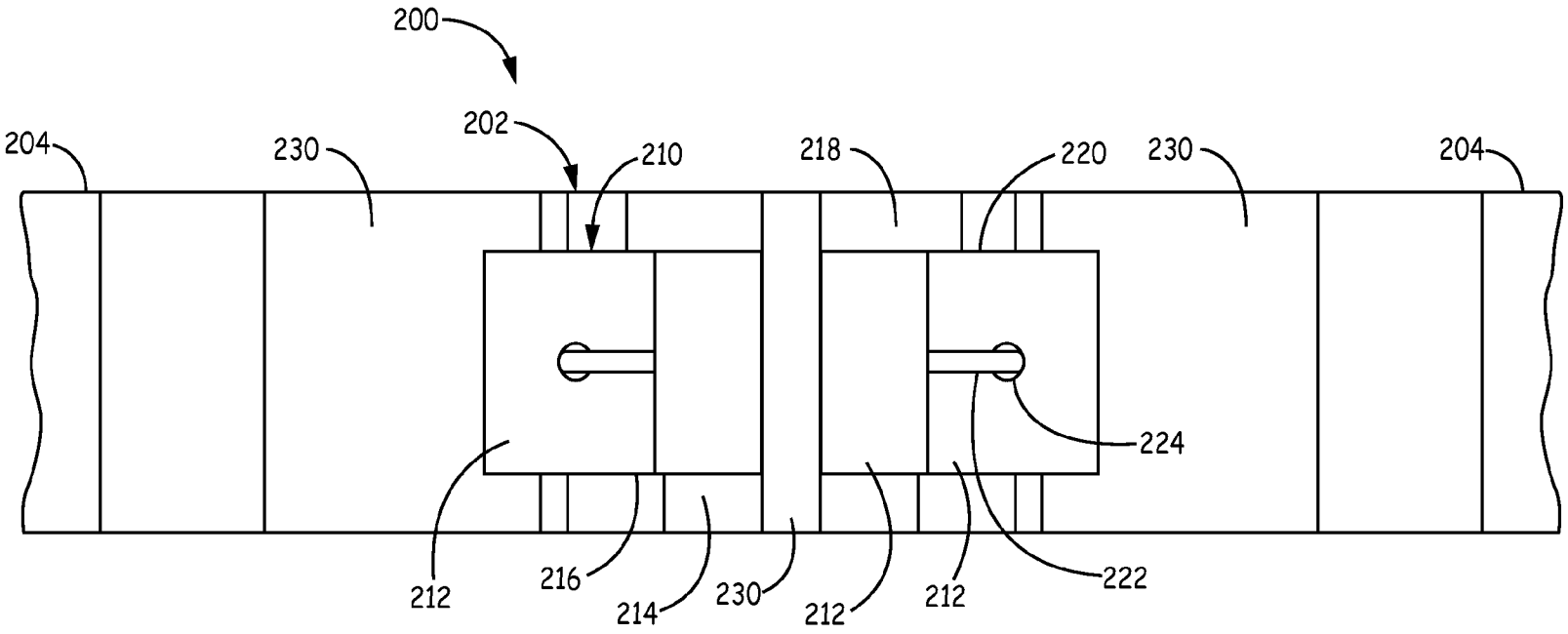
FIG. 2B is a side view of the circulator of FIG. 2A.

FIGS. 2A and 2B illustrate a circulator 200 with asymmetric dielectric spacers according to another embodiment, in which the dielectric spacers have different diameters as described further hereafter. The circulator 200 includes similar components as discussed above for circulator 100. For example, circulator 200 includes a waveguide housing 202, which includes a plurality of waveguide arms 204 such as three waveguide arms that extend from a central cavity of housing 202, with each waveguide arm 204 having a port 206 that provides a signal interface.

A ferrite element 210 is disposed in the central cavity of waveguide housing 202. The ferrite element 210 includes a plurality of segments 212 that each protrude toward a separate waveguide arm 204. As shown in the exemplary embodiment of FIG. 2A, ferrite element 210 has a Y-shaped structure with three segments 212.

A first dielectric spacer 214 is disposed on a first surface 216 of ferrite element 210 and a second dielectric spacer 218 is disposed on a second surface 220 of ferrite element 210. The first dielectric spacer 214 and the second dielectric spacer 218 have the substantially the same circular shape but the first dielectric spacer 214 has a smaller diameter than the second spacer 218, as shown most clearly in FIG. 2B. The different diameters for the dielectric spacers 214 and 218 allow one spacer to be undersized along the short wall (E-plane) dimension of the circulator while still preserving the same effective dielectric constant as the other spacer.

In one embodiment, dielectric spacer 214 and dielectric spacer 218 can be composed of the same dielectric materials. In other embodiments, dielectric spacer 214 and dielectric spacer 218 can be composed of different dielectric materials, such as those described above for spacers 114 and 118, and/or can have substantially the same thickness or different thicknesses.

The first spacer 214 is used to securely position ferrite element 210 in waveguide housing 202 and provides a thermal path out of ferrite element 210. For example, the first spacer 214 can be bonded to waveguide housing 202. The second spacer 218 can be separated from waveguide housing 202 by an air gap in some embodiments.

A magnetizing winding 222 can be threaded through a channel 224 in segments 212 in order to make ferrite element 210 switchable. In addition, a dielectric transformer 230 can be attached to each end of a segment 212 that protrudes toward a respective waveguide arm 204.

Figure 3:
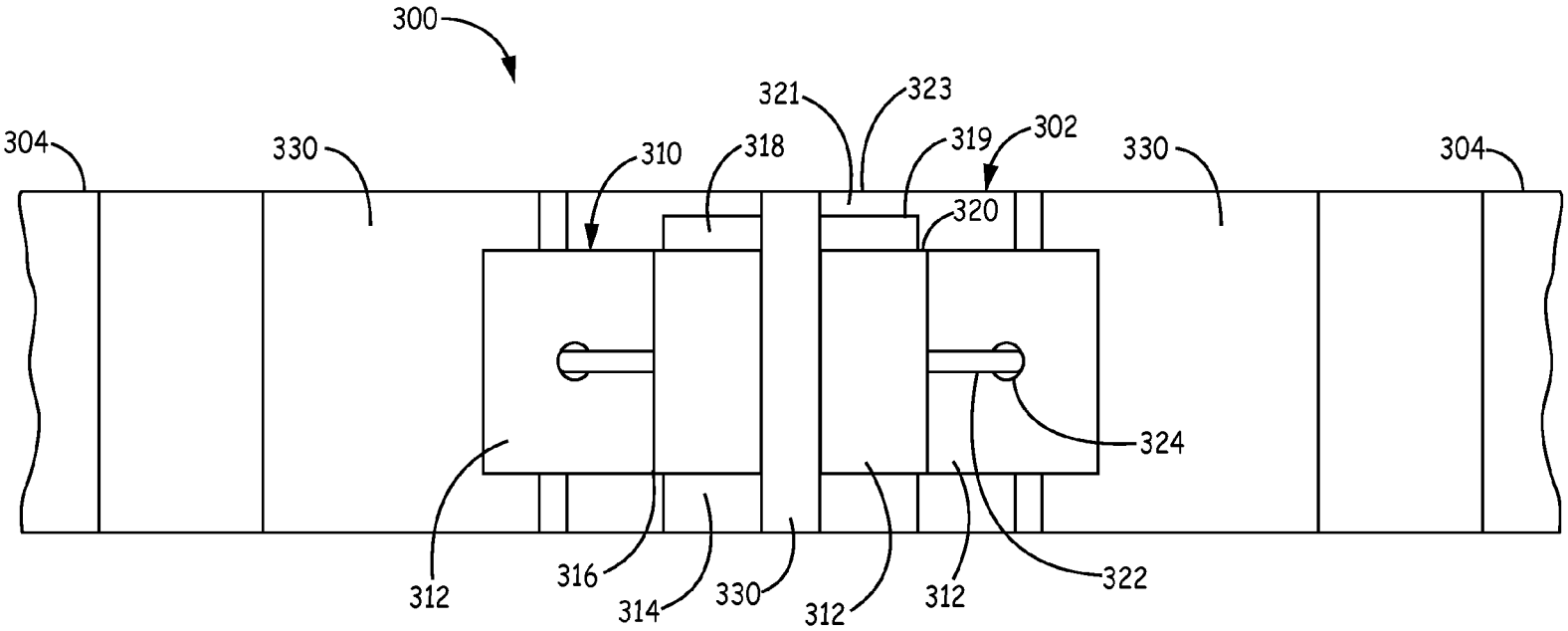
FIG. 3 is a side view of a circulator with asymmetric dielectric spacers according to a further embodiment.

FIG. 3 illustrates a circulator 300 with asymmetric dielectric spacers according to a further embodiment, in which the dielectric spacers have different thicknesses as described hereafter. The circulator 300 includes similar components as discussed above for circulator 100. For example, circulator 300 includes a waveguide housing 302, which includes a plurality of waveguide arms 304.

A ferrite element 310 is disposed in a central cavity of waveguide housing 302. The ferrite element 310 includes a plurality of segments 312 that each protrude toward a separate waveguide arm 304.

A first dielectric spacer 314 is disposed on a first surface 316 of ferrite element 310 and a second dielectric spacer 318 is disposed on a second surface 320 of ferrite element 310. The first dielectric spacer 314 and the second dielectric spacer 318 have substantially the same circular shape, but the first dielectric spacer 314 has a thickness along a height dimension that is greater than a thickness (height) of the second dielectric spacer 318. The different thicknesses for the dielectric spacers 314 and 318 provide a margin for the total stackup height (e.g., an air gap between the second spacer and a broad wall) to improve yield.

In one embodiment, dielectric spacer 314 and dielectric spacer 318 can be composed of the same dielectric materials. In other embodiments, dielectric spacer 314 and dielectric spacer 318 can be composed of different dielectric materials, such as those described above for spacers 114 and 118, and/or can have substantially the same diameters or different diameters.

The first dielectric spacer 314 is used to securely position ferrite element 310 in waveguide housing 302 and provides a thermal path out of ferrite element 310. For example, the first dielectric spacer 314 can be bonded to waveguide housing 302. The second dielectric spacer 318 is separated from waveguide housing 302 by an air gap 321, which is located between a top surface 319 of dielectric spacer 318 and an upper broad wall 323 of waveguide housing 302.

A magnetizing winding 322 can be threaded through a channel 324 in segments 312 in order to make ferrite element 310 switchable. In addition, a dielectric transformer 330 can be attached to each end of a segment 312 that protrudes toward a respective waveguide arm 304.

Figure 4A:
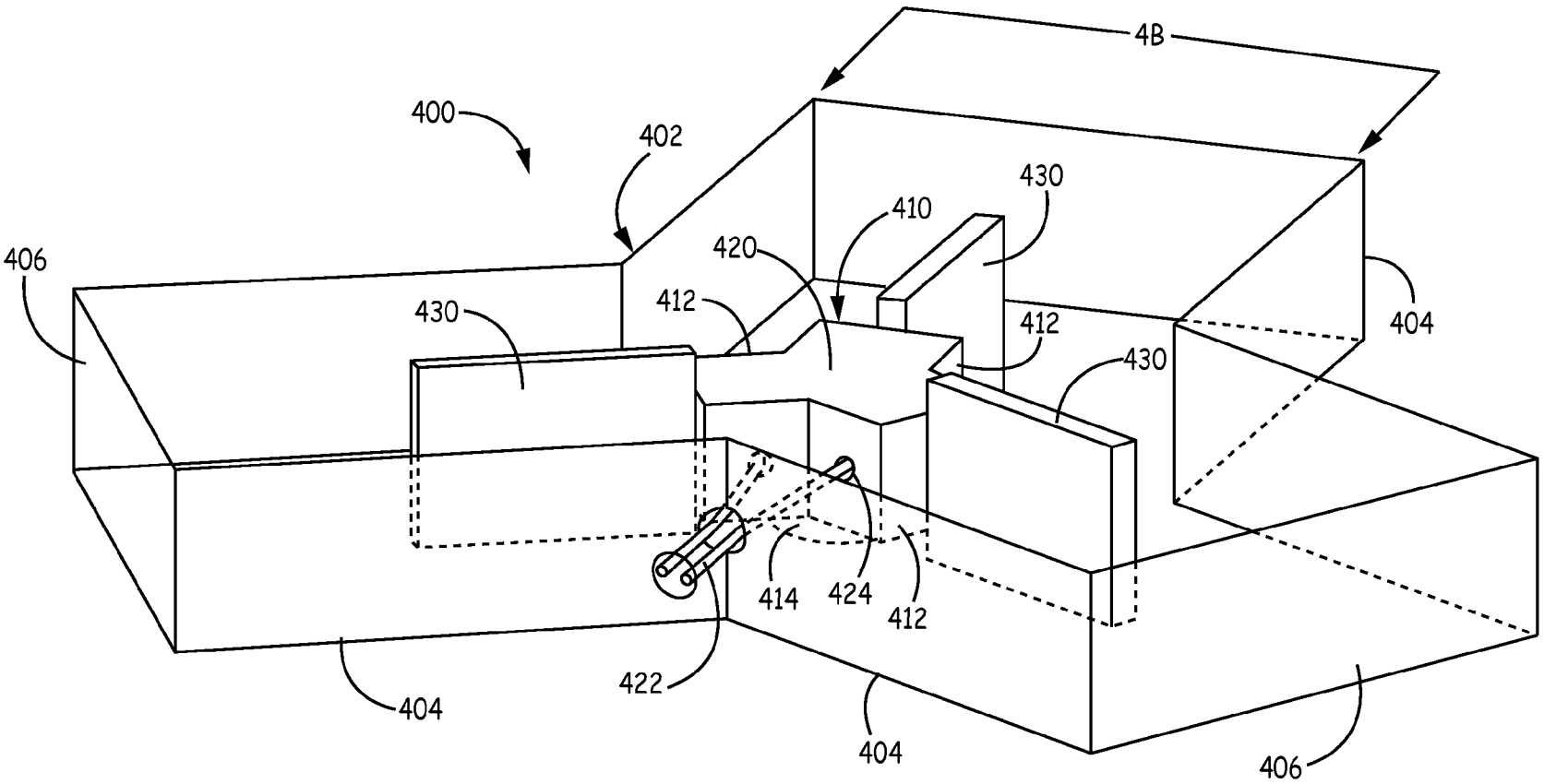
FIG. 4A is an isometric view of a circulator with a single dielectric spacer according to an alternative embodiment.
Figure 4B:
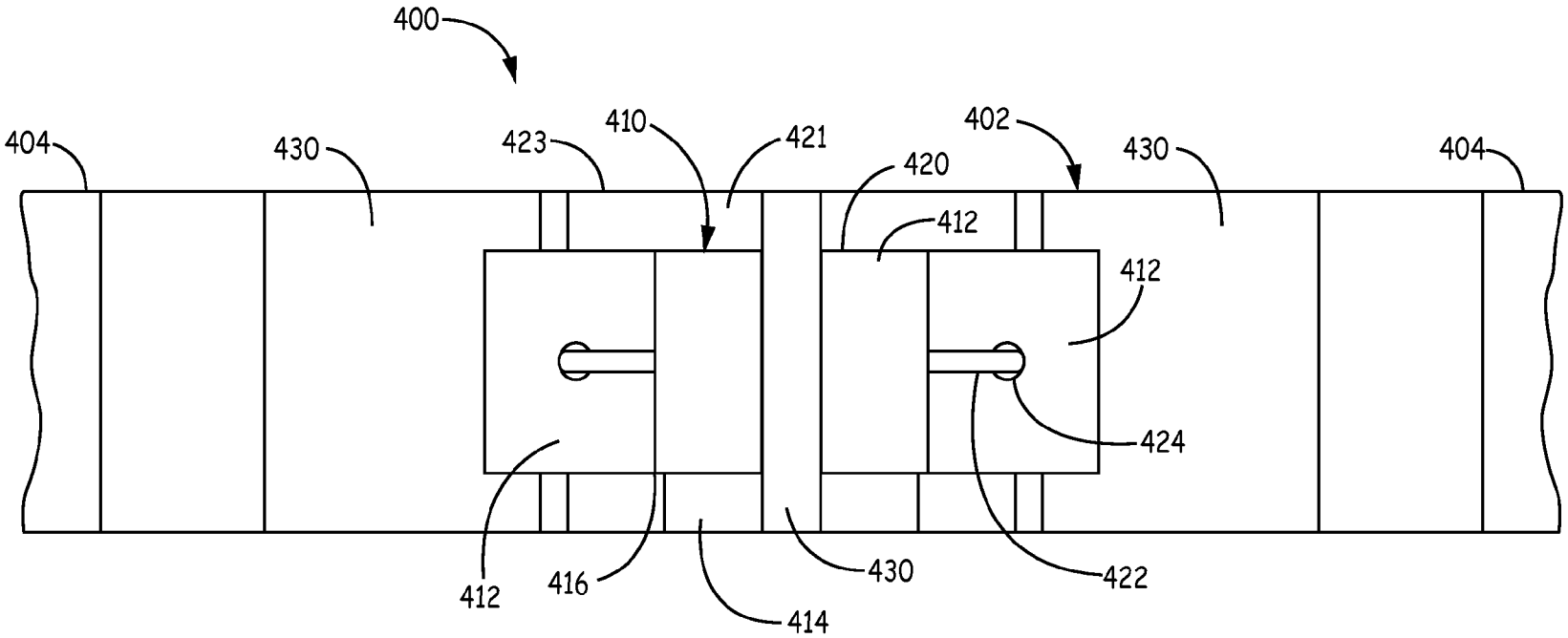
FIG. 4B is a side view of the circulator of FIG. 4A.

FIGS. 4A and 4B illustrate a circulator 400 according to an alternative embodiment, in which only one dielectric spacer is utilized as described further hereafter. The circulator 400 includes similar components as discussed above for circulator 100. For example, circulator 400 includes a waveguide housing 402, which includes a plurality of waveguide arms 404 such as three waveguide arms that extend from a central cavity of housing 402, with each waveguide arm 404 having a port 406 that provides a signal interface.

A ferrite element 410 is disposed in the central cavity of waveguide housing 402. The ferrite element 410 includes a plurality of segments 412 that each protrude toward a separate waveguide arm 404. As shown in the exemplary embodiment of FIG. 4A, ferrite element 410 has a Y-shaped structure with three segments 412.

Unlike the other embodiments described previously, a spacer is not placed on a top (second) surface 420 of ferrite element 410. Rather, only a single dielectric spacer 414 is affixed to a bottom (first) surface 416 of ferrite element 410, with an air gap 421 located between top surface 420 and an upper broad wall 423 of waveguide housing 402. The dielectric spacer 414 is used to securely position ferrite element 410 in waveguide housing 402 and provides a thermal path out of ferrite element 410.

A magnetizing winding 422 can be threaded through a channel 424 in segments 412 in order to make ferrite element 410 switchable. In addition, a dielectric transformer 430 can be attached to each end of a segment 412 that protrudes toward a respective waveguide arm 404.

Figure 5:
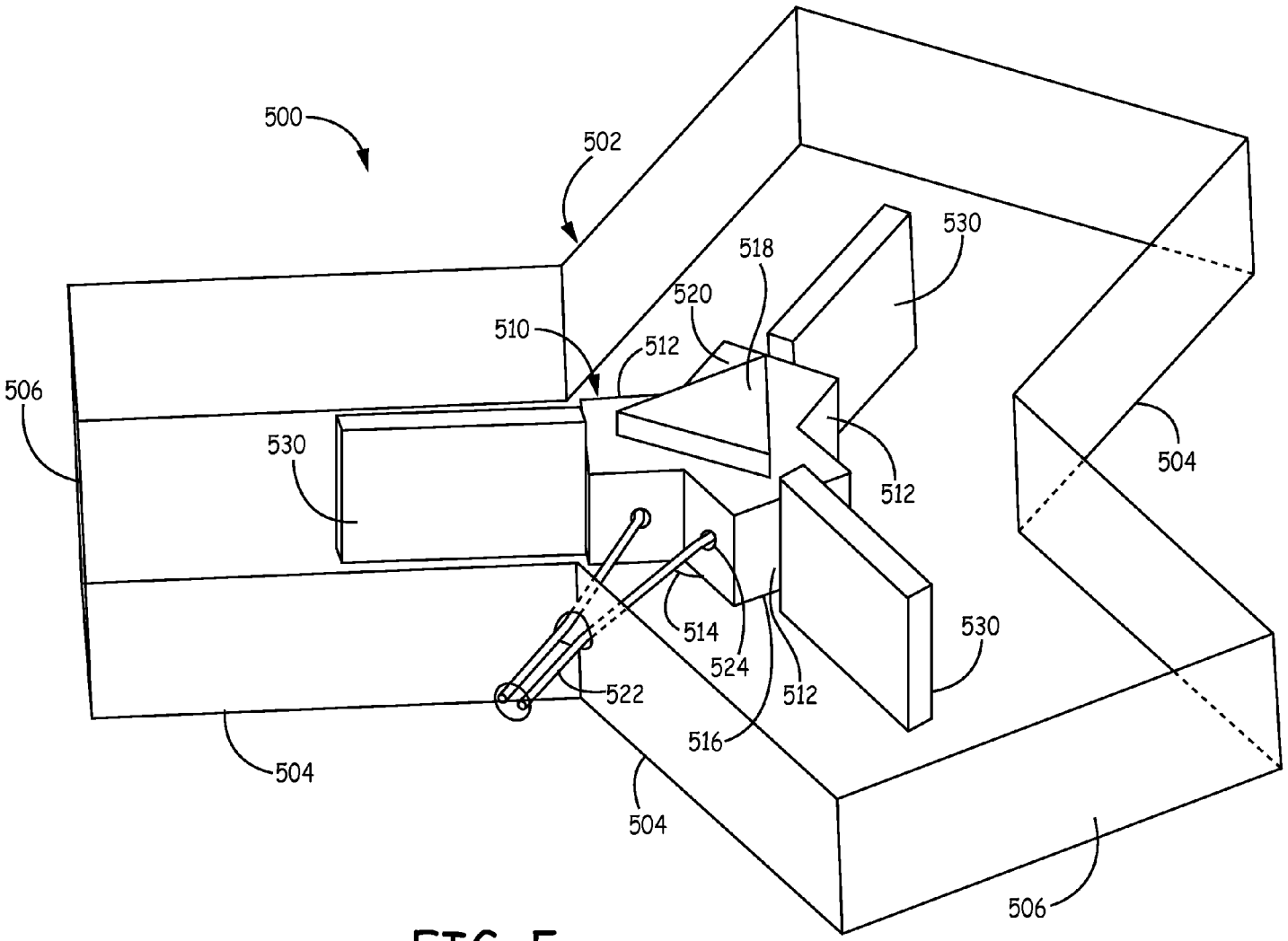
FIG. 5 is an isometric view of a circulator with asymmetric dielectric spacers according to another embodiment.

FIG. 5 illustrates a circulator 500 with asymmetric dielectric spacers according to another embodiment, in which the dielectric spacers have different shapes as described further hereafter. The circulator 500 includes similar components as discussed above for circulator 100. For example, circulator 500 includes a waveguide housing 502, which includes a plurality of waveguide arms 504 such as three waveguide arms that extend from a central cavity of housing 502, with each waveguide arm 504 having a port 506 that provides a signal interface.

A ferrite element 510 is disposed in the central cavity of waveguide housing 502. The ferrite element 510 includes a plurality of segments 512 that each protrude toward a separate waveguide arm 504. As shown in the exemplary embodiment of FIG. 5, ferrite element 510 has a Y-shaped structure with three segments 512.

A first dielectric spacer 514 is disposed on a first surface 516 of ferrite element 510 and a second dielectric spacer 518 is disposed on a second surface of ferrite element 510. The first dielectric spacer 514 and the second dielectric spacer 518 have different shapes. For example, the second dielectric spacer 518 can have a triangular shape and the first dielectric spacer 514 can have a circular shape. The different shapes for the dielectric spacers 514 and 518 provide potential improvement to RF performance.

In one embodiment, dielectric spacer 514 and dielectric spacer 518 can be composed of the same dielectric materials. In another embodiment, dielectric spacer 514 and dielectric spacer 518 can be composed of different dielectric materials, such as those described above for spacers 114 and 118, and/or can have substantially the same thickness or different thicknesses.

The first dielectric spacer 514 is used to securely position ferrite element 510 in waveguide housing 502 and provides a thermal path out of ferrite element 510. A magnetizing winding 522 can be threaded through a channel 524 in segments 512 in order to make ferrite element 510 switchable. In addition, a dielectric transformer 530 can be attached to each end of a segment 512 that protrudes into a respective waveguide arm 504.

The present invention may be embodied in other forms without departing from its essential characteristics. The described embodiments are to be considered in all respects only as illustrative and not restrictive. Therefore, it is intended that this invention be limited only by the claims and the equivalents thereof.

What is claimed is:

1. A circulator, comprising:

a waveguide housing including a central cavity;

a ferrite element disposed in the central cavity of the waveguide housing, the ferrite element including a first surface and an opposing second surface; and a pair of asymmetric dielectric spacers including a first dielectric spacer located on the first surface of the ferrite element, and a second dielectric spacer located on the second surface of the ferrite element;

wherein the first and second dielectric spacers have different shapes.

2. The circulator of claim 1, wherein the first and second dielectric spacers comprise the same dielectric materials.

3. The circulator of claim 1, wherein the first and second dielectric spacers have substantially the same thickness.

4. The circulator of claim 1, wherein the first and second dielectric spacers have different thicknesses.

5. The circulator of claim 1, wherein the first dielectric spacer has a lower dielectric constant than the second dielectric spacer.

6. The circulator of claim 1, wherein the first and second dielectric spacers have different sizes.

7. The circulator of claim 1, wherein the first dielectric spacer has a circular shape and the second dielectric spacer has a triangular shape.

8. A switching waveguide circulator, comprising:

a waveguide housing including a central cavity and a plurality of waveguide arms that extend from the central cavity;

a ferrite element disposed in the central cavity of the waveguide housing, the ferrite element including a plurality of segments that each protrude toward a respective one of the waveguide arms, the ferrite element including a first surface and an opposing second surface;

a pair of asymmetric dielectric spacers including a first dielectric spacer located on the first surface of the ferrite element, and a second dielectric spacer located on the second surface of the ferrite element; and a magnetizing winding disposed in the segments of the ferrite element;

wherein the first and second dielectric spacers have different shapes.

9. The circulator of claim 8, wherein the first and second dielectric spacers comprise the same dielectric materials.

10. The circulator of claim 8, wherein the first and second dielectric spacers have substantially the same thickness.

11. The circulator of claim 8, wherein the first and second dielectric spacers have different thicknesses.

12. The circulator of claim 8, wherein the first dielectric spacer has a lower dielectric constant than the second dielectric spacer.

13. The circulator of claim 8, wherein the first and second dielectric spacers have different sizes.

14. The circulator of claim 8, wherein the first dielectric spacer has a circular shape and the second dielectric spacer has a triangular shape.

15. A circulator, comprising:

a waveguide housing including a central cavity;

a ferrite element disposed in the central cavity of the waveguide housing, the ferrite element including a first surface and an opposing second surface; and a pair of asymmetric dielectric spacers including a first dielectric spacer located on the first surface of the ferrite element, and a second dielectric spacer located on the second surface of the ferrite element;

wherein the first and second dielectric spacers have different shapes;

wherein the first dielectric spacer has a different dielectric constant than the second dielectric spacer.

16. The circulator of claim 15, wherein the first and second dielectric spacers have substantially the same thickness.

17. The circulator of claim 15, wherein the first and second dielectric spacers have different thicknesses.

18. The circulator of claim 15, wherein the first and second dielectric spacers have different sizes.

* * * * *